US009085993B2

(12) United States Patent
Nishimoto et al.

(10) Patent No.: US 9,085,993 B2
(45) Date of Patent: Jul. 21, 2015

(54) COOLING METHOD AND COOLING DEVICE FOR A SINGLE-FLOW TURBINE

(75) Inventors: Shin Nishimoto, Tokyo (JP); Yoshinori Tanaka, Tokyo (JP); Tatsuaki Fujikawa, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 1040 days.

(21) Appl. No.: 12/958,884

(22) Filed: Dec. 2, 2010

(65) Prior Publication Data

US 2011/0203275 A1 Aug. 25, 2011

(30) Foreign Application Priority Data

Dec. 21, 2009 (JP) ..... 2009-289415

(51) Int. Cl.
*F01D 25/12* (2006.01)
*F01D 11/04* (2006.01)
(Continued)

(52) U.S. Cl.
CPC ..... *F01D 25/12* (2013.01); *F01D 5/08* (2013.01); *F01D 21/003* (2013.01); *F05D 2220/31* (2013.01); *F05D 2260/2322* (2013.01)

(58) Field of Classification Search
CPC ..... F05D 2220/31; F05D 1/00; F05D 1/02; F05D 1/04; F05D 11/003; F05D 11/04; F05D 11/06; F05D 11/02; F05D 25/12; F05D 21/003; F05D 5/08; F05D 2260/2322; F05B 2220/301
USPC ..... 415/1, 104, 105, 106, 109, 111, 112, 415/175, 180, 168.1, 168.2, 168.4; 416/1, 416/174
See application file for complete search history.

(56) References Cited

U.S. PATENT DOCUMENTS 1,494,354 A * 5/1924 Guy ..... 415/61
2,212,471 A * 8/1940 Hagemann ..... 415/47
(Continued)

FOREIGN PATENT DOCUMENTS

CN 1127327 7/1996
CN 101063414 10/2007
(Continued)

OTHER PUBLICATIONS

International Search Report issued Feb. 15, 2011 in International (PCT) Application No. PCT/JP2010/070599 with English translation.
(Continued)

*Primary Examiner* — Dwayne J White
*Assistant Examiner* — Joshua R Beebe
(74) *Attorney, Agent, or Firm* — Wenderoth, Lind & Ponack, L.L.P.

(57) ABSTRACT

It is intended to effectively cool a dummy ring and a rotor disposed on the inner side of the dummy ring of a single-flow turbine and to suppress a decrease in thermal efficiency by preventing main steam from leaking to the dummy ring side. A cooling steam supply pipe 32 is provided in the dummy ring 26 of the single-flow turbine 10A and extraction steam of a boiler at 570° C. or below is supplied to a clearance c between the dummy ring 26 and the turbine rotor 12 as cooling steam $S_4$. The cooling steam $S_4$ has lower temperature and higher pressure than leak steam $S_2$ which is a portion of the main steam $S_1$ leaking to the dummy ring 26 side. By supplying the cooling steam $S_4$, the leak steam $S_2$ is prevented from entering the dummy ring 26 side and the dummy ring 26, a welding part w and a second rotor part 12*b* with low heat resistance that are disposed on the inner side of the dummy ring 26 can be cooled.

26 Claims, 4 Drawing Sheets

(51) Int. Cl.

| | |
|---|---|
| ***F01D 11/02*** | (2006.01) |
| ***F01D 5/08*** | (2006.01) |
| ***F01D 21/00*** | (2006.01) |

(56) References Cited

U.S. PATENT DOCUMENTS

| | | | | |
|---|---|---|---|---|
| 2,467,818 | A * | 4/1949 | Elston | 415/108 |
| 2,552,239 | A * | 5/1951 | Warren | 415/112 |
| 3,351,396 | A * | 11/1967 | Oechslin | 277/347 |
| 4,498,301 | A * | 2/1985 | Tsubouchi | 60/657 |
| 2005/0022527 | A1 | 2/2005 | Nagane et al. | |
| 2006/0245911 | A1* | 11/2006 | Suga et al. | 415/108 |
| 2008/0085192 | A1* | 4/2008 | Fukuda et al. | 416/244 R |
| 2009/0185895 | A1* | 7/2009 | Wieghardt | 415/104 |
| 2010/0021283 | A1* | 1/2010 | Parry et al. | 415/116 |
| 2011/0085886 | A1* | 4/2011 | Kasibhotla et al. | 415/1 |

FOREIGN PATENT DOCUMENTS

| | | | | |
|---|---|---|---|---|
| JP | 59-58101 | | 4/1984 | |
| JP | 1-113101 | | 7/1989 | |
| JP | 9-125909 | | 5/1997 | |
| JP | 11-141302 | | 5/1999 | |
| JP | 11-229818 | | 8/1999 | |
| JP | 2000-274208 | | 10/2000 | |
| JP | 2001-200707 | | 7/2001 | |
| JP | 2006/046088 | | 2/2006 | |
| JP | 2008-88525 | | 4/2008 | |
| WO | WO 2007/051733 | * | 5/2007 | F01D 3/04 |

OTHER PUBLICATIONS

International Preliminary Report on Patentability and Written Opinion of the International Searching Authority issued Jul. 19, 2012 in International (PCT) Application No. PCT/JP2010/070599 with English translation.

Korean Notice of Allowance issued Nov. 26, 2013 in corresponding Korean Patent Application No. 10-2012-7000495 with English translation.

Japanese Decision to Grant a Patent issued Mar. 13, 2013 in corresponding Japanese Patent Application No. 2011-547410 with English translation.

Office Action issued Mar. 3, 2014, in corresponding Chinese Application No. 201080035908.6 (with English translation).

* cited by examiner

COOLING METHOD AND COOLING DEVICE FOR A SINGLE-FLOW TURBINE

BACKGROUND OF THE INVENTION

1. Field of the Invention

The present invention relates to a method and a device for cooling a dummy ring of a single-flow turbine which is installed in a steam turbine generator facility and which steam of high temperature is introduced to, and a rotor which is arranged on an inner side of the dummy ring.

2. Description of the Related Art

From a perspective of saving energy and preserving the environment (reducing $CO_2$) in recent years, a larger capacity and improved thermal efficiency is desired in a steam turbine power plant. The thermal efficiency is improved by raising a temperature and a pressure of main steam. The steam having a maximum temperature of approximately 600° C. is currently used in a coal-fired power generation including a steam turbine. However, The power plant using a steam having a high temperature of 700 to 750° C. is desired to further enhance the thermal efficiency.

Meanwhile, the turbine rotor is exposed to high stress due to the rotation of the turbine rotor. Thus, the turbine rotor needs to have such a structure as to withstand a high temperature and high stress. A cooling technique of the turbine rotor is an important issue in the trend of using the main steam of high temperature. In such a case of using the steam of 600° C. class, high-chrome steel (ferritic heat resisting steel) such as 12% Cr steel is used for major parts of the turbine rotor, the rotor blades and so on so as to tolerate the above condition of the steam.

However, in such a case of using the steam of 700° C. class, high-chrome steel such as 12% Cr steel does not provide enough strength. In view of this, it is possible to use Ni base alloy, which has more strength against high temperature. However, Ni base alloy is hard to be produced in large masses and also expensive. It is unrealistic to produce a turbine rotor by using Ni base alloy exclusively.

Patent Document 1 discloses a turbine rotor configured such that Ni base alloy is used for high temperature parts which must be made of Ni base alloy and steel materials such as CrMoV steel are used for other parts. The parts made of Ni base alloy and other parts made of CrMoV steels are welded together at a connection part and the connection part and other parts made of CrMoV steels are kept at 580° C. or below. As CrMoV steel, there are high-Cr-steel containing Cr 9.0 to 10% by weight or low-CrMoV-steel containing Cr 0.85 to 2.5% by weight.

FIG. 4 shows a partial sectional view of a conventional single-flow ultrahigh pressure turbine from a front thereof. In FIG. 4, the single-flow ultrahigh pressure turbine 100 includes an inner casing 104 surrounding a turbine rotor 102 and an outer casing 106 surrounding the inner casing 104 on an outer side of the inner casing 104. Further, a nozzle chamber 108 is arranged on an inner side of the inner casing 104. A main steam supply pipe 114 is arranged through the outer casing 106 and the inner casing 104 in a radial direction, and is connected to the nozzle chamber 108. The nozzle chamber 108 has a main steam injection opening 110 toward the turbine blade row so as to direct the main steam $S_1$ toward the turbine blade row.

On an immediate downstream side of the main steam injection opening 110, first stage blades 112 are implanted in a first stage blade part 102*a* of the turbine rotor 102. The main steam $S_1$ being injected gives the first stage blades 112 a rotational force. On a downstream side of the first stage blades 112, a plurality of stator blades implanted in the inner casing 104 and a plurality of rotating blades implanted in the turbine rotor 102 are alternately arranged so as to form a multi-stage blade row (unshown). The main steam $S_1$ through the multi-stage blade row gives the turbine rotor 102 a rotational force.

The dummy ring 116 for balancing the thrust of the blade row is arranged behind the nozzle chamber 108. Further, a dummy part 102*b* of the turbine rotor 102 is arranged to face the dummy ring 116. A labyrinth seal 118 is provided in a clearance c between the dummy ring 116 and the dummy part 102*b* so as to prevent the steam from entering the clearance c. A portion of the main steam $S_1$ injected from the main steam injection opening 110 leaks to the dummy ring 116 side through the clearance between outer surfaces of the turbine rotor 102 and the nozzle chamber 108.

An exhaust steam discharge pipe 120 is arranged in a radial direction through the outer casing 106 and the dummy ring 116. One end of the exhaust steam discharge pipe 120 is in communication with the clearance c.

Leak steam $S_2$ leaking to the dummy ring 116 side, is led to the exhaust steam discharge pipe 120 through the clearance c, and then joins a steam pipe 122 which feeds steam to a high pressure turbine of a subsequent stage via the exhaust steam discharge pipe 120. The leak steam $S_2$ passing through the exhaust steam discharge pipe 120 also functions to balance the thrust force loaded on the turbine rotor 102.

As described above, in the single-flow turbine on the high pressure side such as the single-flow high ultrahigh pressure turbine 100, the steam of high temperature which is not working to rotate the turbine rotor 102 can leak to the dummy ring 116 side through the clearance c between the dummy ring 116 and the dummy part 102*b* of the turbine rotor 102. This can expose the dummy ring 116 and the turbine rotor 102 to high temperature atmosphere. Thus, methods of cooling these exposed parts of the dummy ring 16 and the turbine rotor 102 have been proposed.

For instance, FIG. 1 of Patent Document 2 discloses a steam turbine of a single-casing type in which a portion of exhaust steam discharged from a high-pressure turbine is supplied to a blade row inlet 44 of a medium-pressure turbine via a pipe 105 as a cooling steam. The numbers used here are the same as shown in FIG. 1 of Patent Document 2.

In a steam turbine of a single-casing type illustrated in FIG. 1 of Patent Document 3, a portion of exhaust steam discharged from a high-pressure turbine is supplied to an inlet of a medium-pressure turbine via a thrust balance pipe 106 as a cooling steam. The numbers used here are the same as shown in FIG. 1 of Patent Document 3.

Particularly, with such a configuration of the turbine rotor 102 that parts made of different materials such as Ni base alloy and CrMoV steel are connected together by welding or the like, the connection part has lower strength against high temperature than the rest of the turbine rotor 102. In such a case that the connection part is located in the clearance c, the connection part is exposed to the leak steam of high temperature. This can deteriorate the strength of the connection part and a special maintenance is required.

To take measure against this, Patent Document 4 proposes a cooling method for cooling the connection part as shown in FIG. 13 of Patent Document 4. According to the cooling method, a shielding plate shielding the connection part (bolting part) of the turbine rotor is provided in communication with a cooling steam supply pipe for feeding cooling steam to the shielding plate 22. The cooling steam is fed into the shielding plate 22 to cooling the connection part. The numbers used here are the same as shown in FIG. 13 of Patent Document 4.

RELATED ART DOCUMENT

Patent Document

[PATENT DOCUMENT 1] JP2008-88525A
[PATENT DOCUMENT 2] JP1-113101A (FIG. 1)
[PATENT DOCUMENT 3] JP9-125909 (FIG. 1)
[PATENT DOCUMENT 4] JP2000-274208 (FIG. 13)

SUMMARY OF THE INVENTION

Object of the Present Invention

The cooling means for the single-casing steam turbine that are illustrated in FIG. 1 of Patent Document 2 and FIG. 1 of Patent Document 3 cools the inlet part of the medium-pressure turbine part. The cooling means do not cool the dummy ring and the dummy part of the turbine rotor arranged on the inner side of the dummy ring.

Specifically, in the single-casing steam turbine illustrated in Patent Document 1 and Patent Document 2, the discharge steam of the high-pressure side turbine part is supplied to an area between the dummy ring dividing the high-pressure side turbine part and the medium-pressure turbine part. The discharge steam has a pressure lower than that of the leak steam which parts from the main steam supplied to the high-pressure side turbine rotor and streams in the clearance between the dummy ring and the dummy part of the turbine rotor, and thus, the discharge steam flows into the medium-pressure turbine part side.

Therefore, the discharge steam and the leak steam stream together into the medium-pressure turbine part side so as to cool the medium-pressure turbine part. Thus, it is impossible to cool the dummy ring and the dummy part of the turbine rotor to the temperature of the leak steam or below.

The cooling means is disclosed in Patent Document 4. However, Patent Document 4 does not specifically disclose as to which steam source the cooling steam is supplied, what is the pressure of the cooling steam supplied to the inside of an shielding plate 22 and so on.

As described above, there is no cooling means yet that cools the dummy ring and the turbine rotor disposed on the inner side of the dummy ring of the single-flow turbine and the parts still requires strength to withstand high temperature. And the main steam leaking to the dummy ring side is wasted without doing any work with respect to the turbine rotor, thereby reducing the heat efficiency of the single-flow turbine.

In view of the issues above of the related art, it is an object of the present invention is to effectively cool the dummy ring and the rotor disposed on the inner side of the dummy ring of the single-flow turbine and to suppress a decrease in thermal efficiency by preventing the main steam from leaking to the dummy ring side.

Means to Achieve the Object

To achieve the above object, the present invention provides a cooling method of cooling a dummy ring and a rotor surrounded by the dummy ring of a single-flow high pressure turbine which is integrated in a steam turbine generator facility and into which steam of high temperature is introduced. The method may include, but is not limited to, the steps of: supplying cooling steam generated in the steam turbine generator facility to a cooling steam supply path arranged in the dummy ring, the cooling steam having lower temperature and higher pressure than leak steam which is a portion of main steam supplied to the single-flow turbine and leaks to the dummy ring side; and cooling the dummy ring and the rotor by introducing the cooling steam to a clearance formed between the dummy ring and the rotor via the cooling steam supply path and feeding the cooling steam in the clearance.

In the cooling method, the cooling steam has lower temperature and higher pressure than the leak steam which is a portion of the main steam supplied to the single-flow turbine and leaks to the dummy ring side and the cooling steam is supplied to the clearance between the dummy ring and the rotor via the cooling steam supply path. By this, the area around the dummy ring is filled with the cooling steam having high pressure, thereby preventing the leak steam parting from the main steam from entering the area. As a result, the cooling effect of the dummy ring and the rotor near the inner side of the dummy ring can be improved in comparison to the conventional cooling means described above.

By this, the temperature rise of the dummy ring and the turbine rotor can be prevented, there is no longer need for special life management of the dummy ring and the rotor and the parts last longer. This increases the freedom of choosing material used for components such as the rotor. In the vicinity of the dummy ring, it is no longer necessary to use Ni-base alloy having high heat resistance in a large area as the material of the rotor, thereby reducing the area of the rotor made of Ni-base alloy. As a result, the production of the rotor becomes easier.

In the present invention, the steam generated in the steam turbine generator facility can be properly selected and used as the cooling steam. Thus, it becomes easier to obtain the cooling steam.

The main steam to be supplied to the single-flow turbine has higher temperature and higher pressure than the leak steam. Therefore, it is preferable that the cooling steam has a temperature lower than the main steam and a pressure not lower than the main steam. By this, the area around the dummy ring is filled with the cooling steam having high pressure, thereby preventing the leak steam parting from the main steam from entering the area.

The cooling method of the aspect of the present invention may further include the step of: after the step of cooling the dummy ring and the rotor, discharging the cooling steam and the leak steam to an exhaust steam pipe via a cooling steam discharge path which is formed through the dummy ring and arranged closer to a nozzle chamber supplying the main steam than the cooling steam supply path, the exhaust steam pipe supplying the steam and the leak steam to a blade cascade part of the single-flow turbine or a steam turbine of a subsequent stage. As described above, the cooling steam having cooled the dummy ring and the rotor as well as the leak steam via the cooling steam discharge path is discharged to the blade cascade part of the single-flow turbine or the discharge steam pipe. Therefore, it is possible to recover the steam as a part of the steam for the steam turbine of the subsequent stage and the medium/low pressure turbine.

The area of the clearance except for the area where the leak steam flows can be filled with the cooling steam. Thus, the cooling effect of the dummy ring and the rotor can be improved in comparison with the conventional cooling means.

The leak steam and the cooling steam having cooled the dummy ring and the rotor are discharged through the cooling steam discharge path. Thus, the cooling steam can be recovered as a part of the steam for the steam turbine of the subsequent stage and the medium/low pressure turbine.

In the present invention, it is preferable that the cooling steam is supplied to the cooling steam supply path at 570° C.

or below. By this, even in the case wherein the rotor is made of heat-resistant steel material such as 12% Cr steel and CrMoV steel instead of Ni-base alloy, the rotor can last long without special life management of the rotor.

In the present invention, it is preferable that the cooling steam is one of: exhaust steam from an ultrahigh pressure turbine or a high pressure turbine; extraction steam of a blade cascade part; and extraction steam of a boiler. By this, the cooling steam can be easily obtained in the steam turbine generator facility.

In the present invention, even in the case wherein the main steam of the single-flow turbine has a temperature of 700° C. and above, the dummy ring and the rotor on the inner side of the dummy ring can be cooled by supplying the cooling steam to the cooling steam supply path. As a result, the dummy ring and the rotor can last long.

The rotor may have a first rotor part made of a heat-resistant material and a second rotor part made of material having lower heat resistance than the first rotor part. The first rotor part and the second rotor part may be connected via a connection part, and the connection part may be disposed on an inner side of the dummy ring. This improves the cooling effect of the second rotor part and the connection part and thus, the decrease of the strength can be prevented and the longer life thereof can be achieved without conducting special life management of the second rotor part and the connection part.

As an aspect of the present invention, a cooling device of cooling a dummy ring and a rotor surrounded by the dummy ring of a single-flow high pressure turbine which is integrated in a steam turbine generator facility and into which steam of high temperature is introduced, may include, but is not limited to: a cooling steam supply path which is formed in the dummy ring and opens to a clearance formed between the dummy ring and the rotor; and a cooling steam pipe which is connected to the cooling steam supply path and supplies cooling steam generated in the steam turbine generator facility to the cooling steam supply path, the cooling steam having lower temperature and higher pressure than leak steam which is a portion of main steam supplied to the single-flow and leaks to the dummy ring side. The cooling steam is introduced to the clearance formed between the dummy ring and the rotor via the cooling steam supply path so as to cool the dummy ring and the rotor.

In the device of the aspect of the present invention, the cooling steam has lower temperature and higher pressure than the leak steam which is a portion of main steam supplied to the single-flow and leaks to the dummy ring side. The cooling steam is introduced to the clearance formed between the dummy ring and the rotor via the cooling steam supply path. By this, the area around the dummy ring is filled with the cooling steam having high pressure and thus, the leak steam parting from the main steam is prevented from entering the area. Therefore, the cooling effect of the dummy ring and the rotor near the inner side of the dummy ring can be improved in comparison to the conventional cooling means of the related art. This increases the freedom of choosing material used for components such as the rotor, and achieves the longer life of the dummy ring and the turbine rotor without special life management thereof by preventing the temperature rise of the dummy ring and the turbine rotor.

The main steam to be supplied to the single-flow turbine has higher temperature and higher pressure than the leak steam that leaks to the dummy ring side. Thus, in the device of the aspect of the present invention, it is preferable that the cooling steam has a temperature lower than the main steam and a pressure not lower than the main steam. By this, the area around the dummy ring can be filled with the cooling steam having high pressure and thus, the leak steam parting from the main steam can be easily prevented from entering the area.

The cooling device of the aspect of the present invention may further include a cooling steam discharge path which is formed in the dummy ring and arranged closer to a nozzle chamber supplying the main steam than the cooling steam supply path such as to open to the clearance, and is connected to an exhaust steam pipe which supplies the steam to a blade cascade part of the single-flow turbine or a steam turbine of a subsequent stage. The cooling steam having streamed in the clearance is discharged with the leak steam to the exhaust steam pipe via the cooling steam discharge path.

In this manner, the cooling steam having cooled the dummy ring and the rotor as well as the leak steam diverging from the main steam is discharged from the cooling steam discharge path. Thus, the cooling steam and the leak steam can be recovered as a part of the steam for the steam turbine of the subsequent stage and the medium/low pressure turbine. The area of the clearance except for the area where the leak steam flows can be filled with the cooling steam. Thus, the cooling effect of the dummy ring and the rotor can be improved in comparison with the conventional cooling means of the related art.

The cooling device of the aspect of the present invention may further include a cooling unit which is arranged in the cooling steam pipe and cools the cooling steam that is above 570° C. to 570° C. and below. The cooling steam is cooled to 570° C. and below by the cooling unit and supplies to the cooling steam supply path. By this, even in the case wherein the cooling steam obtained from the steam turbine generator facility is above 570° C., the cooling steam can be cooled to 570° C. and below by the cooling unit and then supplied to the cooling steam supply path. The cooling effect of the dummy ring and the rotor can be firmly achieved. As a result, it becomes easier to obtain from the steam turbine generator facility the cooling steam source that is at 570° C. or below.

Effects of the Invention

According to the present invention, the cooling method of cooling a dummy ring and a rotor surrounded by the dummy ring of a single-flow high pressure turbine which is integrated in a steam turbine generator facility and into which steam of high temperature is introduced, includes the steps of: supplying cooling steam generated in the steam turbine generator facility to a cooling steam supply path arranged in the dummy ring, the cooling steam having lower temperature and higher pressure than leak steam which is a portion of main steam supplied to the single-flow turbine and leaks to the dummy ring side; and cooling the dummy ring and the rotor by introducing the cooling steam to a clearance formed between the dummy ring and the rotor via the cooling steam supply path and feeding the cooling steam in the clearance. Therefore, the leak steam diverging from the main steam is prevented from entering the dummy ring side while the clearance can be filled with the cooling steam. As a result, the cooling effect of the dummy ring and the rotor can be improved in comparison to the conventional cooling means of the related art.

By this, the temperature rise of the dummy ring and the turbine rotor can be prevented, there is no longer need for special life management of the dummy ring and the rotor and the parts last longer. This increases the freedom of choosing material used for components such as the rotor. Particularly, the area of the rotor made of Ni-base alloy or the like with high heat resistance can be reduced. As a result, the production of the rotor becomes easier.

In the present invention, the steam generated in the steam turbine generator facility can be properly selected and used as the cooling steam. Thus, it becomes easier to obtain the cooling steam.

According to the present invention, the cooling device of cooling a dummy ring and a rotor surrounded by the dummy ring of a single-flow high-pressure turbine which is integrated in a steam turbine generator facility and into which steam of high temperature is introduced, includes: a cooling steam supply path which is formed in the dummy ring and opens to a clearance formed between the dummy ring and the rotor; and a cooling steam pipe which is connected to the cooling steam supply path and supplies cooling steam generated in the steam turbine generator facility to the cooling steam supply path, the cooling steam having lower temperature than the main steam supplied to the single-flow turbine and a pressure the same as or higher than the main steam. The cooling steam is introduced to the clearance formed between the dummy ring and the rotor via the cooling steam supply path so as to cool the dummy ring and the rotor. This achieves the same function effects as the cooling method of the aspect of the present invention.

DETAILED DESCRIPTION OF THE PREFERRED EMBODIMENTS

A preferred embodiment of the present invention will now be described in detail with reference to the accompanying drawings. It is intended, however, that unless particularly specified, dimensions, materials, shape, its relative positions and the like shall be interpreted as illustrative only and not limitative of the scope of the present invention.

First Preferred Embodiment

Figure 1:
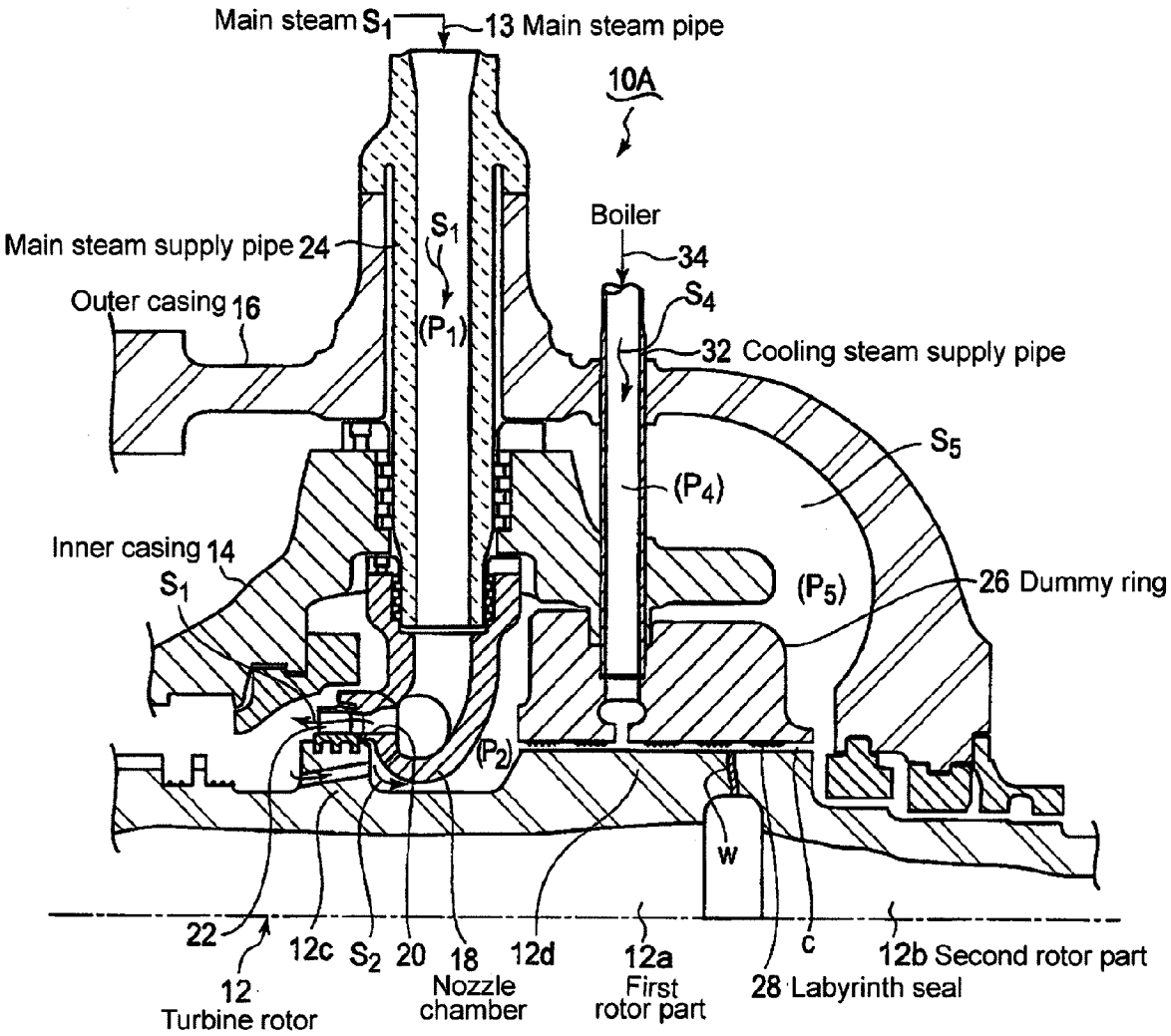
FIG. 1 A sectional view taken from the front of an ultrahigh pressure turbine of single-flow type in relation to a first preferred embodiment, to which the present invention is applied.

A first preferred embodiment in which the present invention is applied to an ultrahigh pressure turbine of a single-flow type, is explained in reference to FIG. 1. FIG. 1 is a sectional view taken from the front of an ultrahigh pressure turbine 10A of single-flow type in relation to the first preferred embodiment. The ultrahigh pressure turbine 10A of single-flow type is integrated in a steam turbine power plant. FIG. 1 shows the single-flow ultrahigh pressure turbine 10A. The ultrahigh pressure turbine 10A has an inner casing 14 surrounding a turbine rotor 12 and an outer casing 16 surrounding the inner casing 14 on an outer side of the inner casing. Further, a nozzle chamber 18 is arranged on an inner side of the inner casing 14 to inject the main steam. A main steam supply pipe 24 is arranged through the outer casing 16 and the inner casing 14 in a radial direction, and its tip is connected to the nozzle chamber 18.

The nozzle chamber 18 has a main steam injection opening 20 toward the turbine blade row so as to inject the main steam $S_1$ supplied to the main steam supply pipe toward the turbine blade row to the turbine blade row.

On an immediate downstream side of the main steam injection opening 20, first stage rotating blades 22 are implanted in a first stage rotating blade part 12*c* of the turbine rotor 12. The main steam $S_1$ injected from the main steam injection opening 20 gives the first stage rotating blades 22 a rotational force. On a downstream side of the first stage rotating blades 22, a plurality of stationary blades implanted in the inner casing 14 and a plurality of rotating blades implanted in the turbine rotor 12 are alternately arranged so as to form a multi-stage blade row of reaction type (unshown). The main steam $S_1$ through the multi-stage blade row gives the turbine rotor 12 a rotational force.

The dummy ring 26 for balancing the thrust of the blade row is arranged behind the nozzle chamber 18. Further, a dummy part 12*d* of the turbine rotor 12 is arranged to face the dummy ring 26. A labyrinth seal 28 is provided in a clearance c between the dummy ring 26 and the dummy part 12*d*. In the turbine rotor 12, a first rotor part 12*a* and a second rotor part 12*b* are joined at a welding part w. The first rotor part 12*a* subjected to the main steam $S_1$ of high temperature of 700° C. or above is made of Ni base alloy having an excellent heat resistance. The second rotor part 12*b* not subjected to the main steam $S_1$ is made of heat resistant steel having heat resistance lower than Ni base alloy, such as 12% Cr steel. The welding part w is arranged on the inner side of the dummy ring 26 and in the vicinity of an opening of a cooling steam supply pipe 32.

The cooling steam supply pipe 32 is arranged through the outer casing 16 and the inner casing 14 in a radial direction and opens to the clearance c. The cooling steam supply pipe 32 connects to a steam pipe 34 to supply extraction steam from a boiler unshown to the cooling steam supply pipe 32 via the steam pipe 34 as cooling steam $S_4$. The cooling steam $S_4$ has steam pressure $P_4$ equal to or higher than the steam pressure $P_1$ of the main steam $S_1$ and is supplied to the cooling steam supply pipe 32 at 570° C. or below.

A portion of the main steam $S_1$ injected from the main steam injection opening 20 may leak to the dummy ring 26 side as leak steam $S_2$ through the clearance between the turbine rotor 12 and the nozzle chamber 18. Meanwhile, the cooling steam $S_4$ having the above-described pressure and temperature is supplied to the clearance c from the cooling steam supply pipe 32 and thus, the cooling steam $S_4$ works against the leak steam $S_2$ so as to prevent the leak steam $S_2$ from entering the dummy ring 26 side and flowing into the entire clearance c.

In the case above, this inequality (1) exists in each area.

$$P_4 \geq P_1 > P_2 > P_5 \quad (1)$$

"$P_2$" is the steam pressure of the leak steam $S_2$. "$P_5$" is the pressure in the space $S_5$ between the outer casing 16 and the inner casing 14. The steam pressure $P_4$ of the cooling steam $S_4$ is higher than the pressure $P_5$ of the space $S_5$ and thus, leaking of the steam can be prevented by providing labyrinth seals 28 between the cooling steam supply pipe 32 and the exist of the clearance c which opens to the space $S_5$.

According to the preferred embodiment, the cooling steam $S_4$ is supplied to the clearance c, and the pressure difference between the steam pressure $P_4$ of the cooling steam $S_4$ and the pressure $P_2$ of the leak steam $S_2$ prevents the leak steam $S_2$ from entering the dummy ring 26 side.

In this manner, it is possible to prevent heat transfer from the leak steam $S_2$ to the dummy ring 26 and the turbine rotor 12. Therefore, the turbine rotor 12 near the lower portion of the nozzle chamber including the dummy ring 26 and the dummy part 12*d* on the inner side of the dummy ring 26 can be cooled to 570° C. or below. The welding part w with lower high temperature strength can be effectively cooled as well.

Therefore, there is no longer need for special life management of the welding part w and the second rotor part 12*b* and it is possible to reduce the leak steam $S_2$ that is not used to rotate the turbine rotor 12. As a result, the heat efficiency of the ultrahigh pressure turbine 10A of single-flow type can be improved.

Second Preferred Embodiment

Figure 2:
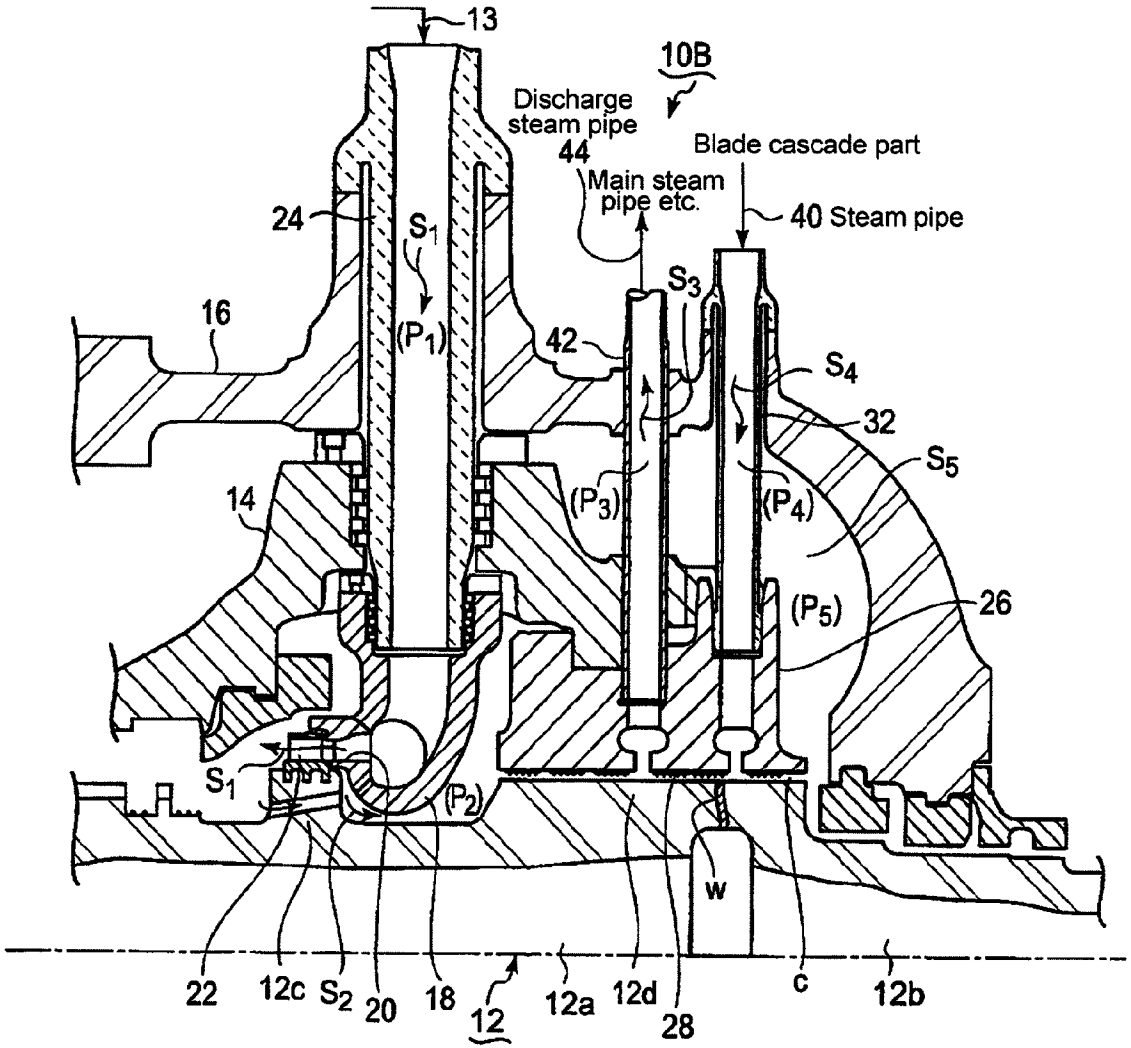
FIG. 2 A sectional view taken from the front of an ultrahigh pressure turbine of single-flow type in relation to a second preferred embodiment, to which the present invention is applied.

A second preferred embodiment in which the present invention is applied to an ultrahigh pressure turbine of a single-flow type, is explained in reference to FIG. 2. In an ultrahigh pressure turbine 10B of single-flow type that is shown in FIG. 2, the cooling steam supply pipe 32 is arranged through the outer casing 16 and the inner casing 14 in a radial direction. In comparison to the cooling steam supply pipe 32 of the first preferred embodiment, the cooling steam supply pipe 32 of the second preferred embodiment is arranged in the dummy ring 26 nearer the space $S_5$ and its tip opens to the clearance c. A cooling steam discharge pipe 42 is arranged through the outer casing and inner casing 14 in a radial direction. The cooling steam discharge pipe 42 is disposed in the dummy ring 26 arranged nearer the nozzle chamber 18 than the cooling steam supply pipe 32 is. The tip of the cooling steam supply pipe 32 opens to the clearance c.

The cooling steam discharge pipe 42 is connected to a main steam pipe which supplies the main steam to the high pressure turbine via a discharge steam pipe 44. The rest of the structure is the same as the first preferred embodiment and thus, is not explained further.

Extraction steam is extracted from a blade cascade part of the ultrahigh pressure turbine 10B of single-flow type at 570° C. or below. The extraction steam is supplied to the cooling steam supply pipe 32 via the steam pipe 40 as the cooling steam $S_4$. The cooling steam $S_4$ is introduced to the clearance c from the cooling steam supply pipe 32 so as to cool the turbine rotor 12 including the dummy ring 26 and the dummy part 12*d* on the inner side of the dummy ring 26. After cooling the turbine rotor 12, the cooling steam $S_4$ is discharged via the cooling steam discharge pipe 42 as discharge steam $S_3$. The discharge steam $S_3$ is fed to the main steam pipe which supplies the main steam to the main steam pipe which supplies the main steam to at least one of an interspace of the blade cascade parts of the ultrahigh pressure turbine 10B and the high pressure turbine not shown.

In the preferred embodiment, the cooling steam $S_4$ is set to meet the condition shown below as (2).

$$P_1>P_4>P_2>P_3\geq P_5 \quad (2)$$

"$P_1$" is the steam pressure of the main steam $S_1$. "$P_2$" is the steam pressure of the leak steam $S_2$ that streams from the main steam $S_1$ and parts to the dummy ring 26 side through the clearance between the turbine rotor 12 and the nozzle chamber 18. "$P_3$" is the steam pressure of the discharge steam streaming in the cooling steam discharge pipe 42. "$P_4$" is the steam pressure of the cooling steam supplied to the cooling steam supply pipe 32. "$P_5$" is the pressure in the space $S_5$ between the outer casing 16 and the inner casing 14. The labyrinth seals 28 are disposed in the clearance c so as to maintain the relation of the pressures as described above. The sealing performance of the clearance c can be maintained.

In the preferred embodiment, a small portion of the main steam $S_1$ injected from the main steam injection opening 20 leaks to the dummy ring 26 side through the clearance between the turbine rotor 12 and the nozzle chamber 18 as the leak steam $S_2$. The leak steam $S_2$ steams through the clearance c and is discharged from the cooling steam discharge pipe 42. The welding part w of the first rotor part 12*a* and the second rotor part 12*b* is disposed between the opening of the cooling steam supply pipe 32 and the opening of the cooling steam discharge pipe 42 and in the vicinity of the opening of the cooling steam supply pipe 32.

According to the preferred embodiment, the cooling steam $S_4$ having the steam pressure $P_4$ is supplied from the cooling steam supply pipe 32. The clearance c from the opening of the cooling steam discharge pipe 42 to the opening of the cooling steam supply chamber 32 is filled with the cooling steam $S_4$ as $P_4>P_2>P_3\geq P_5$. In this area, the cooling effect of the dummy ring 26 and the turbine rotor 12 can be improved. The welding part w and the second rotor part 12*b* are positioned in this area and thus the cooling effect thereof can be improved. The leak steam $S_2$ parting from the main steam $S_1$ is discharged through the cooling steam discharge pipe 42 together with the cooling steam $S_4$ having been used for cooling. The leak steam $S_2$ and the cooling steam $S_4$ can be recovered as a part of the steam for a downstream and medium/low pressure turbine.

In this manner, the cooling effect of the area from the opening of the cooling steam discharge pipe 42 to the cooling steam supply pipe 32 can be improved and thus, the cooling effect of the welding part w and the second rotor part 12*b* that have low heat efficiency can be improved. Therefore, there is no longer need for a special life management of the turbine rotor 12 and the turbine rotor 12 lasts longer.

The cooling steam $S_4$ having been used for cooling and the leak steam $S_2$ stream together as the discharge steam $S_3$ and is discharged through the cooling steam discharge pipe 42. The cooling steam $S_4$ and the leak steam $S_2$ can be recovered as a part of the steam for a downstream and medium/low pressure turbine.

Third Preferred Embodiment

Figure 3:
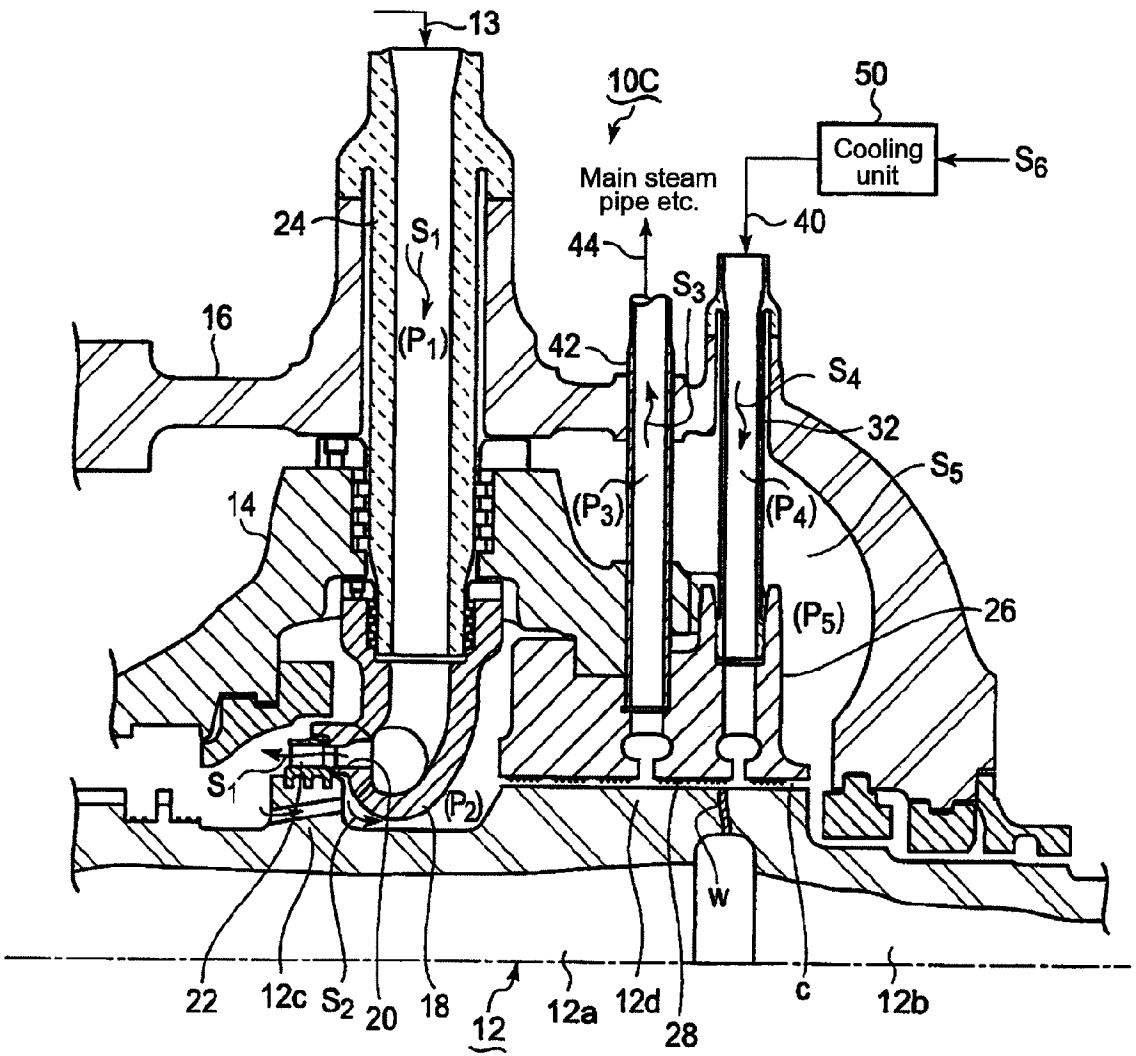
FIG. 3 A sectional view taken from the front of an ultrahigh pressure turbine of single-flow type in relation to a third preferred embodiment, to which the present invention is applied.
Figure 4:
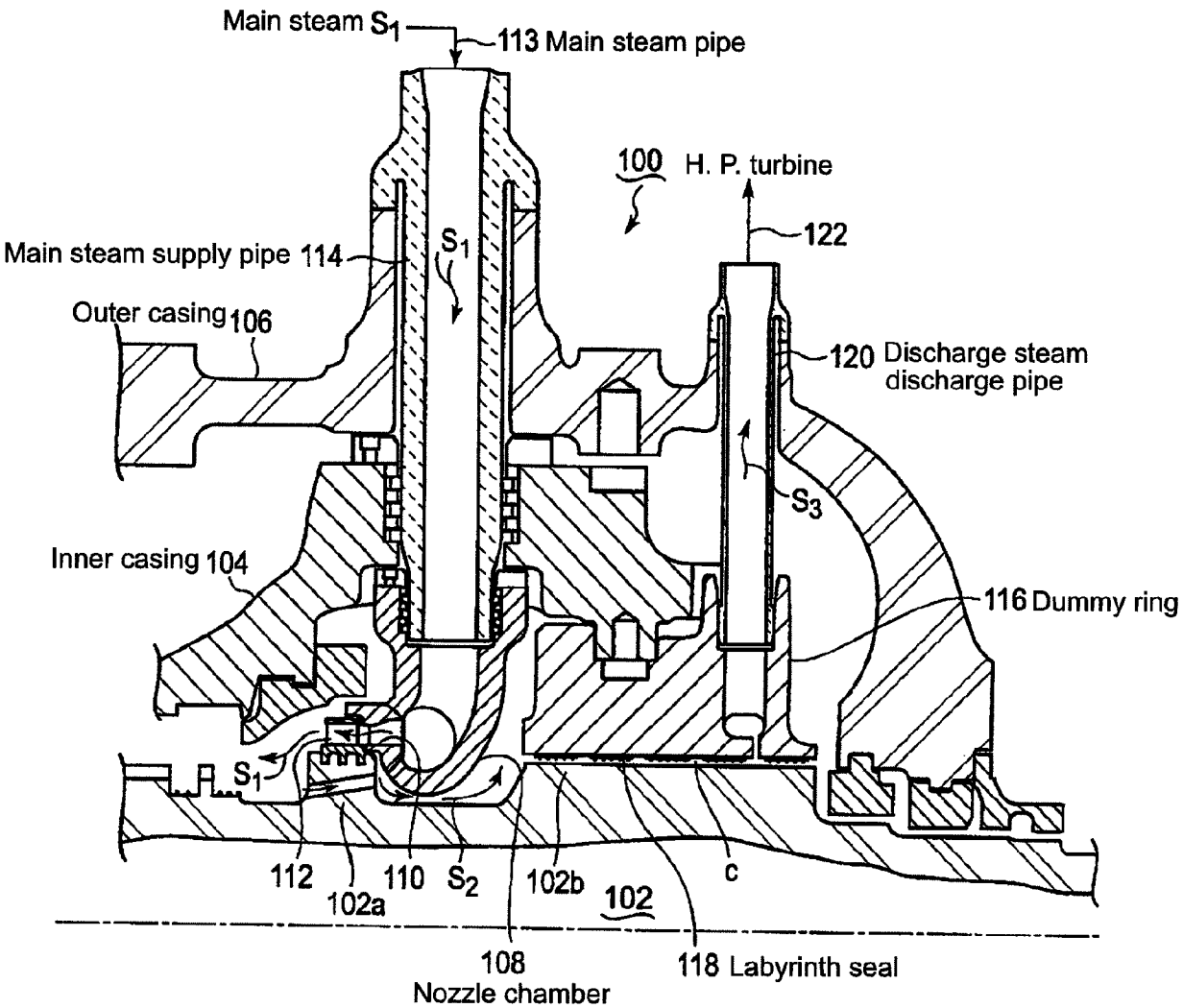
FIG. 4 A sectional view taken from the front of a conventional ultrahigh pressure turbine of a single-flow type.

Next, a third preferred embodiment in which the present invention is applied to an ultrahigh pressure turbine of a single-flow type, is explained in reference to FIG. 3. FIG. 3 shows an ultrahigh pressure turbine 10C of single-flow type. As the cooling steam $S_4$ supplied to the cooling steam supply pipe 32 of the ultrahigh pressure turbine 10C, the steam generated in the steam turbine power plant can be used. For instance, the extraction steam of the boiler, the extraction steam extracted from between the blade cascade parts of the ultrahigh pressure turbine 100 or the discharge steam having been supplied for rotating the turbine rotor 12 in the ultrahigh pressure turbine 12C may be used as the cooling steam $S_4$. The above steams $S_6$ used as the cooling steam $S_4$, does not necessarily have to be at 570° C. or below.

As illustrated in FIG. 3, a cooling unit 50 is arranged in the steam pipe 40 connected to the cooling steam supply pipe 32. In such a case that the steam $S_6$ which serves as the cooling steam $S_4$ is above 570° C., the cooling unit 50 cools the steam $S_6$ to 570° C. and below before supplying it to the cooling steam supply pipe 32. The rest of the structure is the same as that of the second preferred embodiment as shown in FIG. 2.

The cooling unit 50 may be configured such that a spiral-shaped pipe through which the cooling steam $S_6$ streams is provided and a fan blows cold air to the pipe. Alternatively, a pipe equipped with a fin may be provided instead of the spiral-shaped pipe. The cooling unit 50 may have a double pipe structure in which two pipes are provided and cooling water is introduced to one of the pipes so as to cool the cooling steam $S_6$.

In addition to the function effects obtained according to the second preferred embodiment shown in FIG. 2, according to the preferred embodiment, even in such a case that the cooling steam $S_6$ is above 570° C., the cooling unit 50 can cool the steam to 570° C. and below. As a result, there are more options of supply sources for the cooling steam $S_6$ in the steam turbine power plant.

INDUSTRIAL APPLICABILITIES

According to the present invention, in the steam turbine generator facility, the cooling effect of the dummy ring and the turbine rotor on the inner side of the dummy ring can be improved with a simple structure, and the parts can last longer.

The invention claimed is:

1. A cooling method of cooling a dummy ring and a rotor surrounded by the dummy ring of a single-flow high pressure turbine which is integrated in a steam turbine generator facility and into which steam of high temperature is introduced, the method comprising:

supplying cooling steam generated in the steam turbine generator facility to a cooling steam supply path arranged in the dummy ring, the cooling steam having lower temperature and higher pressure than leak steam which is a portion of main steam supplied to a nozzle chamber of the single-flow high pressure turbine and leaks to the dummy ring side; and cooling the dummy ring and the rotor by introducing the cooling steam to a clearance formed between the dummy ring and the rotor via the cooling steam supply path and forcing the cooling steam to flow in the clearance against the leak steam, wherein the rotor has a first rotor part made of heat resistant material and a second rotor part made of heat resistant material having heat resistance lower than the first rotor part and connected to the first rotor part at a connection part, wherein the cooling steam supply path has a part extending through the dummy ring adjacent to the nozzle chamber and an opening which is formed on an inner periphery of the dummy ring adjacent to the nozzle chamber facing the rotor and which opens to the clearance, wherein the inner periphery of the dummy ring has a first region which is located closer to the nozzle chamber than the opening of the cooling steam supply path in an axial direction of the rotor, a second region which is located further away from the nozzle chamber than the opening of the cooling steam supply path in the axial direction of the rotor, wherein a labyrinth seal is provided in each of a clearance between the first region of the inner periphery of the dummy ring and the rotor and a clearance between the second region of the inner periphery of the dummy ring and the rotor, and wherein a part of the rotor includes the connection part and is surrounded by the second region of the inner periphery of the dummy ring, and wherein said cooling operation includes cooling the connection part of the rotor.

2. The cooling method of claim 1, wherein the main steam to be supplied to the single-flow high pressure turbine has higher temperature and higher pressure than the leak steam.

3. The cooling method of claim 2, wherein the cooling steam has a temperature lower than the main stream and a pressure not lower than the main steam.

4. The cooling method of claim 1, wherein the cooling steam has a temperature lower than the main stream and a pressure not lower than the main steam.

5. The cooling method of claim 1, further comprising:

after the step of cooling the dummy ring and the rotor, discharging the cooling steam and the leak steam to an exhaust steam pipe via a cooling steam discharge path which is formed through the dummy ring and arranged closer to the nozzle chamber supplying the main steam than the cooling steam supply path, the exhaust steam pipe supplying the steam and the leak steam to a blade cascade part of the single-flow high pressure turbine or a steam turbine of a subsequent stage.

6. The cooling method of claim 1, wherein the cooling steam is supplied to the cooling steam supply path at 570° C. or below.

7. The cooling method of claim 1, wherein the cooling steam is one of: exhaust steam from an ultrahigh pressure turbine or a high pressure turbine; extraction steam of a blade cascade part; and extraction steam of a boiler.

8. The cooling method of claim 1, wherein the main steam of the single-flow high pressure turbine has a temperature of 700° C. and above.

9. A cooling device for cooling a dummy ring and a rotor surrounded by the dummy ring of a single-flow high pressure turbine which is integrated in a steam turbine generator facility and into which steam of high temperature is introduced, the device comprising:

a cooling steam supply path which is formed in the dummy ring and opens to a clearance formed between the dummy ring and the rotor; and a cooling steam pipe which is connected to the cooling steam supply path and supplies cooling steam generated in the steam turbine generator facility to the cooling steam supply path, the cooling steam having lower temperature and higher pressure than leak steam which is a portion of main steam supplied to a nozzle chamber of the single-flow high pressure and leaks to the dummy ring side, wherein the cooling steam supply path is configured such that the cooling steam is introduced to the clearance formed between the dummy ring and the rotor and forced to flow in the clearance against the leak steam so as to cool the dummy ring and the rotor, wherein the rotor has a first rotor part made of heat resistant material and a second rotor part made of heat resistant material having heat resistance lower than the first rotor part and connected to the first rotor part at a connection part, wherein the cooling steam supply path has a part extending through the dummy ring adjacent to the nozzle chamber and an opening which is formed on an inner periphery of the dummy ring adjacent to the nozzle chamber facing the rotor and which opens to the clearance, wherein the inner periphery of the dummy ring has a first region which is located closer to the nozzle chamber than the opening of the cooling steam supply path in an axial direction of the rotor, a second region which is located further away from the nozzle chamber than the opening of the cooling steam supply path in the axial direction of the rotor, wherein a labyrinth seal is provided in each of a clearance between the first region of the inner periphery of the dummy ring and the rotor and a clearance between the second region of the inner periphery of the dummy ring and the rotor, and wherein a part of the rotor includes the connection part and is surrounded by the second region of the inner periphery of the dummy ring.

10. The cooling device of claim 9, wherein the main steam to be supplied to the single-flow high pressure turbine has higher temperature and higher pressure than the leak steam.

11. The cooling device of claim 10, wherein the cooling steam has a temperature lower than the main steam and a pressure not lower than the main steam.

12. The cooling device of claim 9, wherein the cooling steam has a temperature lower than the main steam and a pressure not lower than the main steam.

13. The cooling device of claim 9, further comprising:

a cooling steam discharge path which is formed in the dummy ring and arranged closer to the nozzle chamber supplying the main steam than the cooling steam supply path such as to open to the clearance, and is connected to an exhaust steam pipe which supplies the steam to a blade cascade part of the single-flow high pressure turbine or a steam turbine of a subsequent stage, wherein the cooling steam having streamed in the clearance is discharged with the leak steam to the exhaust steam pipe via the cooling steam discharge path.

14. The cooling device of claim 9, further comprising:

a cooling unit which is arranged in the cooling steam pipe and cools the cooling steam that is above 570° C. to 570° C. and below, wherein the cooling steam is cooled to 570° C. and below by the cooling unit and supplies to the cooling steam supply path.

15. A cooling method of cooling a dummy ring and a rotor surrounded by the dummy ring of a single-flow high pressure turbine which is integrated in a steam turbine generator facility and into which steam of high temperature is introduced, the method comprising:

supplying cooling steam generated in the steam turbine generator facility to a cooling steam supply path arranged in the dummy ring, the cooling steam having lower temperature and higher pressure than leak steam which is a portion of main steam supplied to a nozzle chamber of the single-flow high pressure turbine and leaks to the dummy ring side;

cooling the dummy ring and the rotor by introducing the cooling steam to a clearance formed between the dummy ring and the rotor via the cooling steam supply path and forcing the cooling steam to flow in the clearance against the leak steam;

after the cooling operation, discharging the cooling steam and the leak steam to an exhaust steam pipe via a cooling steam discharge path which is formed through the dummy ring and arranged closer to the nozzle chamber supplying the main steam than the cooling steam supply path; and supplying the steam and the leak steam, via the exhaust steam pipe, to a blade cascade part of the single-flow high pressure turbine or a steam turbine of a subsequent stage, wherein the cooling steam supply path has a part extending through the dummy ring adjacent to the nozzle chamber and an opening which is formed on an inner periphery of the dummy ring adjacent to the nozzle chamber facing to the rotor and which opens to the clearance, wherein the cooling steam discharge path has a part extending through the dummy ring adjacent to the nozzle chamber and an opening which is formed on the inner periphery of the dummy ring adjacent to the nozzle chamber facing to the rotor and which opens to the clearance, wherein the opening of the cooling steam discharge path is located closer to the nozzle chamber than the opening of the cooling steam supply path in an axial direction of the rotor, wherein the inner periphery of the dummy ring has a first region which is located closer to the nozzle chamber than the opening of the cooling steam discharge path in the axial direction of the rotor, a second region which is located between the opening of the cooling steam discharge path and the opening of the cooling steam supply path in the axial direction of the rotor, and a third region which is located further away from the nozzle chamber than the opening of the cooling steam supply path in the axial direction of the rotor, and wherein a labyrinth seal is provided in each of a clearance between the first region of the inner periphery of the dummy ring and the rotor, a clearance between the second region of the inner periphery of the dummy ring and the rotor, and a clearance between the third region of the inner periphery of the dummy ring and the rotor.

16. The cooling method of claim 15, wherein the main steam to be supplied to the single-flow high pressure turbine has higher temperature and higher pressure than the leak steam.

17. The cooling method of claim 15, wherein the cooling steam has a temperature lower than the main stream and a pressure not lower than the main steam.

18. The cooling method of claim 15, wherein the cooling steam is supplied to the cooling steam supply path at 570° C. or below.

19. The cooling method of claim 15, wherein the cooling steam is one of: exhaust steam from an ultrahigh pressure turbine or a high pressure turbine; extraction steam of a blade cascade part; and extraction steam of a boiler.

20. The cooling method of claim 15, wherein the main steam of the single-flow high pressure turbine has a temperature of 700° C. and above.

21. The cooling method of claim 15, wherein the rotor has a first rotor part made of a heat-resistant material and a second rotor part made of material having lower heat resistance than the first rotor part, the first rotor part and the second rotor part being connected via a connection part, and wherein a part of the rotor includes the connection part and is surrounded by a region of the inner periphery of the dummy ring, the region being located further away from the nozzle chamber than the opening of the cooling steam discharge path in the axial direction of the rotor.

22. A cooling device for cooling a dummy ring and a rotor surrounded by the dummy ring of a single-flow high pressure turbine which is integrated in a steam turbine generator facility and into which steam of high temperature is introduced, the device comprising:

a cooling steam supply path which is formed in the dummy ring and opens to a clearance formed between the dummy ring and the rotor;

a cooling steam pipe which is connected to the cooling steam supply path and supplies cooling steam generated in the steam turbine generator facility to the cooling steam supply path, the cooling steam having lower temperature and higher pressure than leak steam which is a portion of main steam supplied to a nozzle chamber the single-flow high pressure and leaks to the dummy ring side; and a cooling steam discharge path which is formed through the dummy ring and arranged closer to the nozzle chamber supplying the main steam than the cooling steam supply path, the cooling steam discharge path opening to the clearance and being connected to an exhaust steam pipe which supplies the steam to a blade cascade part of the single-flow high pressure turbine or a steam turbine of a subsequent stage, wherein the cooling steam supply path is configured such that the cooling steam is introduced to the clearance formed between the dummy ring and the rotor and forced to flow in the clearance against the leak steam so as to cool the dummy ring and the rotor, wherein the cooling steam discharge path is configured such that the cooling steam is discharged from the clearance with the leak steam to the exhaust steam pipe via the cooling steam discharge path, wherein the cooling steam supply path has a part extending through the dummy ring adjacent to the nozzle chamber and an opening which is formed on an inner periphery of the dummy ring adjacent to the nozzle chamber facing to the rotor and which opens to the clearance, wherein the cooling steam discharge path has a part extending through the dummy ring adjacent to the nozzle chamber and an opening which is formed on the inner periphery of the dummy ring adjacent to the nozzle chamber facing to the rotor and which opens to the clearance, wherein the opening of the cooling steam discharge path is located closer to the nozzle chamber than the opening of the cooling steam supply path in an axial direction of the rotor, wherein the inner periphery of the dummy ring has a first region which is located closer to the nozzle chamber than the opening of the cooling steam discharge path in the axial direction of the rotor, a second region which is located between the opening of the cooling steam discharge path and the opening of the cooling steam supply path in the axial direction of the rotor, and a third region which is located further away from the nozzle chamber than the opening of the cooling steam supply path in the axial direction of the rotor, and wherein a labyrinth seal is provided in each of a clearance between the first region of the inner periphery of the dummy ring and the rotor, a clearance between the second region of the inner periphery of the dummy ring and the rotor, and a clearance between the third region of the inner periphery of the dummy ring and the rotor.

23. The cooling device of claim 22, wherein the main steam to be supplied to the single-flow high pressure turbine has higher temperature and higher pressure than the leak steam.

24. The cooling device of claim 22, wherein the cooling steam has a temperature lower than the main steam and a pressure not lower than the main steam.

25. The cooling device of claim 22, further comprising:

a cooling unit which is arranged in the cooling steam pipe and cools the cooling steam that is above 570° C. to 570° C. and below, wherein the cooling steam is cooled to 570° C. and below by the cooling unit and supplies to the cooling steam supply path.

26. The cooling device of claim 22, wherein the rotor has a first rotor part made of a heat-resistant material and a second rotor part made of material having lower heat resistance than the first rotor part, the first rotor part and the second rotor part being connected via a connection part, and wherein a part of the rotor includes the connection part and is surrounded by a region of the inner periphery of the dummy ring, the region being located further away from the nozzle chamber than the opening of the cooling steam discharge path in the axial direction of the rotor.

* * * * *